US006699119B2

(12) United States Patent
Boulanger et al.

(10) Patent No.: US 6,699,119 B2
(45) Date of Patent: Mar. 2, 2004

(54) ELECTRONICALLY REGULATED SELF-CONTROLLED VENTILATION UNIT

(75) Inventors: Xavier Boulanger, Loubens Lauragais (FR); Patrick Damizet, Venissieux (FR)

(73) Assignee: Aldes Aeraulique (FR)

( * ) Notice: Subject to any disclaimer, the term of this patent is extended or adjusted under 35 U.S.C. 154(b) by 0 days.

(21) Appl. No.: 10/220,332

(22) PCT Filed: Feb. 16, 2001

(86) PCT No.: PCT/FR01/00476

§ 371 (c)(1),
(2), (4) Date: Nov. 27, 2002

(87) PCT Pub. No.: WO01/65185

PCT Pub. Date: Sep. 7, 2001

(65) Prior Publication Data

US 2003/0157882 A1 Aug. 21, 2003

(30) Foreign Application Priority Data

Feb. 29, 2000 (FR) ..... 00 02573

(51) Int. Cl.[7] ..... B08B 15/02
(52) U.S. Cl. ..... 454/61; 454/238
(58) Field of Search ..... 454/184, 61, 238, 454/255; 73/15, 28

(56) References Cited

U.S. PATENT DOCUMENTS

| | | | | |
|---|---|---|---|---|
| 3,415,178 | A | 12/1968 | Ball et al. | |
| 5,257,958 | A | 11/1993 | Jagers | |
| 6,328,647 | B1 * | 12/2001 | Traudt | 454/255 |
| 6,473,668 | B2 * | 10/2002 | Abuzeid et al. | 700/121 |

FOREIGN PATENT DOCUMENTS

| | | |
|---|---|---|
| JP | 07063404 | 3/1985 |
| JP | 07120025 | 5/1995 |

* cited by examiner

*Primary Examiner*—Derek Boles
(74) *Attorney, Agent, or Firm*—Cantor Colburn LLP

(57) ABSTRACT

A ventilation unit is provided comprising an electronically driven ventilator, mounted inside a casing wherein emerge several ducts connected to one or several rooms. Said unit further comprises orifices with specific cross-section, and a differential-pressure sensor measuring the difference in pressure between two predetermined points, said value being transmitted to an analysis and control device, which compares the differential pressure value to a reference value and controls the ventilator, such that it accelerates or slows down it rotational speed, so as to maintain the differential pressure constant and equal to the reference value, to maintain the desired flow rate at said orifices.

16 Claims, 3 Drawing Sheets

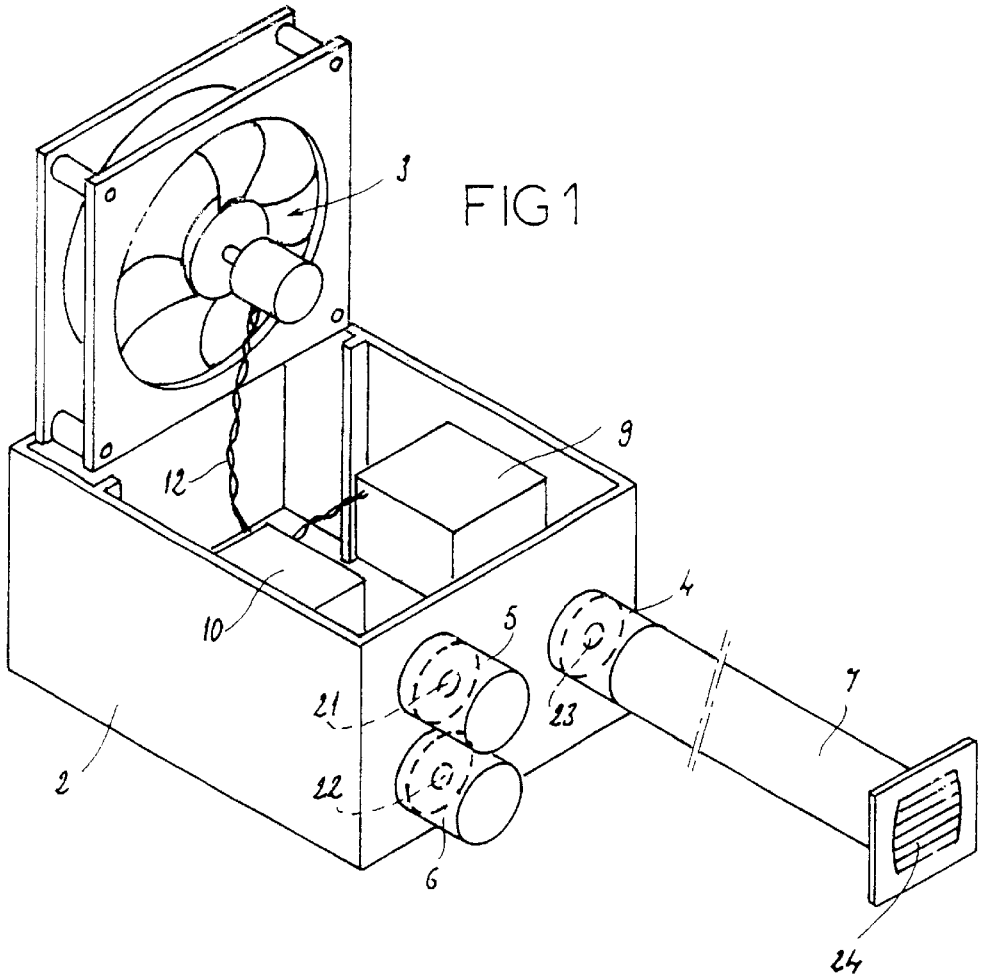
FIG 1
FIG 2
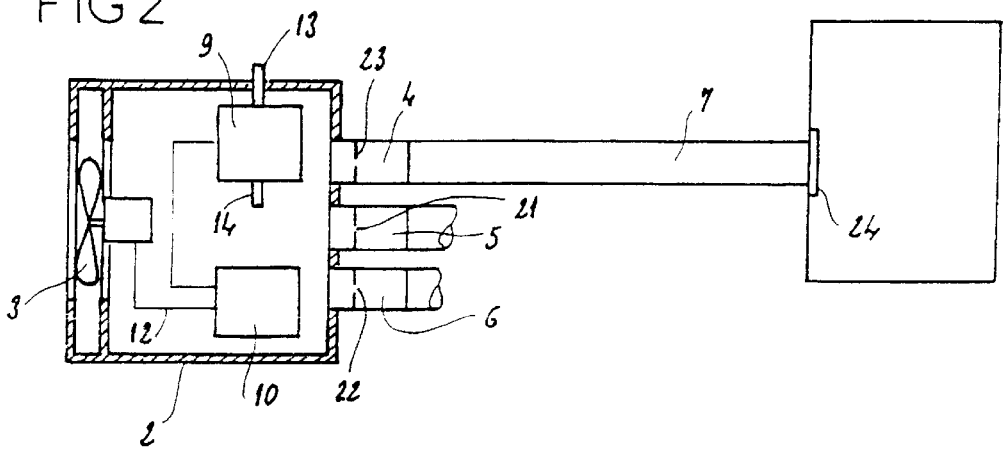

ELECTRONICALLY REGULATED SELF-CONTROLLED VENTILATION UNIT

FIELD OF INVENTION

The present invention relates to an electronically regulated self-controlled ventilation unit operating in extraction or in blowing, allowing control over the flow rates, regardless of the ventilation uses, particularly variations in the number and nature of air intakes, continuous variations in flow rate, or variations in environment, particularly drops in electrical voltage supplied to the fan, variation in back pressure due to the wind, while at the same time optimizing the consumption and the acoustics, for any fan.

BACKGROUND OF INVENTION

In collective or individual homes, or in premises put to economical or industrial use, ventilation has to provide a minimum renewal of air, needed for health, air quality and building life. However, ventilation in which the flow rates are not controlled may lead to significant thermal losses for the premises. As a result, ventilation systems have to render the most stable possible air renewal flow rates while at the same time meeting constraints regarding the minimum flow rates to be provided.

A solution currently known consists in arranging, on the intake ducts, mechanical members which adapt their cross section to the differences in pressure and thus regulate the flow rate. These flow regulating devices are associated with a fan the pressure of which increases with the reduction in flow rate. Although these fans tolerate a broad range of differential pressures, they do have the major acoustic disadvantage of generating a level of noise that increases with the increase in differential pressure. Thus, for low flow rates, the noise generated is higher, and this often forces manufacturers to offer a wide range of drive solutions in order to suit the various configurations of flow rate and in order not to generate needless excess consumption.

In terms of ventilation, there are also needs to modify the flow rate within one configuration.

These needs may be associated with an increase in the pollution or moisture due to human presence. In this case, the variations in flow rate may be continuous and are often associated with a specific fan known as a "flat curve fan", that is to say one which gives a fairly stable pressure for the considered range of flow rates. Other ventilation requirements are associated with sudden specific contaminations, for example the switch to an additional flow rate in the kitchen during cooking, the switch to an additional flow rate in the bathroom when showering. This scenario is generally dealt with by having a two-speed fan where the speeds are suited to the pressure, but only for two known stabilized flow rates, thus proliferating the number of products required as soon as more than two distinct flow rates or several pairs of flow rates are desired.

Thus, a need exists for a ventilation unit equipped with a regulating device allowing it to adapt automatically to suit the various flow rate configurations needed by the premises, such as a home, with one and only one drive solution, which is a conventional drive solution, optimizing the acoustics and the consumption.

BRIEF SUMMARY OF INVENTION

The invention relates to a ventilation unit comprising a fan driven electrically, mounted inside a casing into which there open several ducts connected with one or more rooms, orifices of determined cross section and a differential-pressure sensor measuring a pressure difference between two predetermined points, the measured differential-pressure value being transmitted to an analysis and control device which compares the differential-pressure value with a reference value and controls rotational speed of the fan, so as to keep the differential-pressure value constant and equal to the reference value, and to maintain ventilation flow rates at the orifices at a desired flow rate. This ventilation unit may regulate a differential pressure which results in control over the flow rates at the ends of the ducts which have known passage cross sections and sizes. It is thus possible to get away from the noise associated with the increase in pressure through drop of flow rate and to get away from the use of a very expensive special-purpose fan.

Thus, the invention makes it possible to replace mechanical members for regulating the flow rate with simple calibrated and carefully shaped orifices, thus considerably reducing the overall cost of controlling the flow rates.

The invention may even be suitable for installations with variable flow rate openings, in which the passage cross section depends on the need for ventilation and is independent of the pressure at its ends. In this case, it is each opening which acts as a calibrated orifice.

According to one feature of the invention, the control device acts on the level of supply voltage or on the shape of the supply current supplied to the fan. Depending on whether the fan is a DC fan or an AC fan, control may be had by varying either the voltage or the frequency or by chopping the supply current.

This results in a consumption which is always suited to the ventilation requirements with a low noise level even at low flow rate, and a broad coverage of the possible configurations.

According to one embodiment of the invention, the ventilation flow rates at the orifices of determined cross section are controlled by controlling the absolute pressure in the casing, that is to say the pressure difference between the inside and the outside of the casing.

This solution is very suitable for a network in which the pressure drops are balanced across the various intake ducts and when these intake ducts are short.

According to another embodiment of the invention, the ventilation flow rates at the orifices of determined cross section are controlled by controlling the differential pressure across a calibrated orifice belonging to the casing or across a calibrated orifice, such as an air extraction or inlet opening opening into a room, and of constant or variable cross section.

In this case, the flow rates at the calibrated orifices of constant or variable cross section, such as an air extraction or inlet opening opening into a room, are controlled by controlling the differential pressure across this orifice, the pressure external to the casing being equal to the pressure of the room.

According to further embodiment of the invention, the differential-pressure sensor measures the pressure difference between at least one point situated on an air duct and the inside of the casing.

Advantageously, in this case, and in order to improve the precision with which the flow rate is regulated, the differential-pressure sensor measures the pressure difference between the mean of the pressures inside several air passage ducts and inside the casing.

Several tubes opening into the ducts converge into a tube which is connected to the sensor.

In any event, the invention will be clearly understood with the aid of the description which follows, with reference to the appended diagrammatic drawing which, by way of nonlimiting examples, depicts several embodiments of this electronically regulated self-controlled ventilation unit.

BRIEF DESCRIPTION OF DRAWINGS

FIG. 1 is an exploded perspective view of a ventilation unit according to the invention;

FIGS. 2 to 4 are diagrammatic views each illustrating connection for measuring the differential pressure for controlling the ventilation unit according to the invention.

DETAILED DESCRIPTION OF INVENTION

Figure 3:
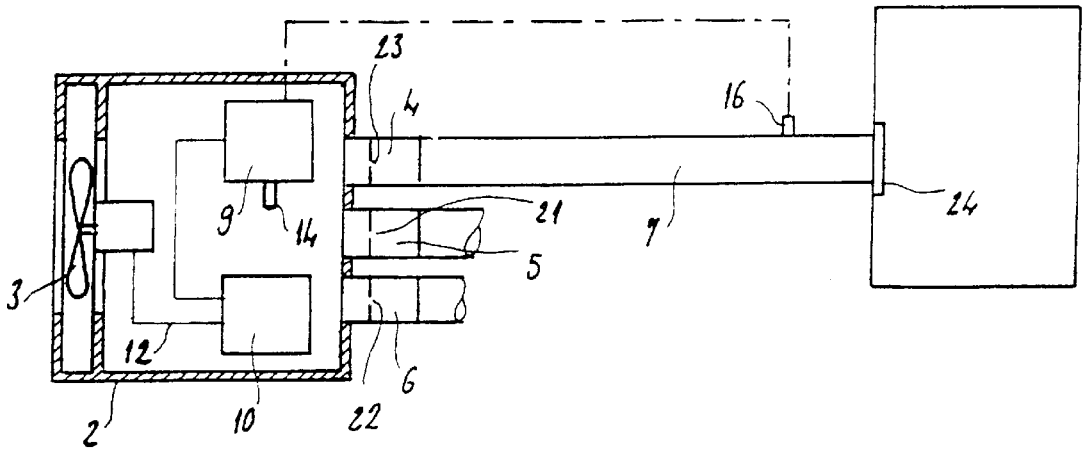

A ventilation unit depicted in FIG. 1 comprises a casing 2 equipped with a fan 3 comprising an electric motor. The casing 2 is equipped with three tappings 4, 5 and 6 allowing the fitting of three calibrated orifices 21, 22 and 23 and three ducts 7, just one of which is depicted in the drawing. Each duct 7 opens via its other end into a room, where it is equipped with a simple grating 24 to make it more attractive. A differential-pressure sensor 9 is mounted inside the casing, which is connected to a box 10 for analyzing the differential pressure and for controlling the fan and which acts on the electrical supply 12 thereof.

According to a first embodiment of the invention depicted in FIG. 2, the differential-pressure sensor 9 measures the absolute pressure in the casing 2, that is, the pressure difference between the inside and the outside of the casing 2. To this end, a pressure tapping tube 13 opens outside of the casing and another pressure tapping tube 14 opens into the casing.

FIG. 3 depicts a second embodiment of the invention in which the same elements are denoted by the same references as before. In this case, the differential-pressure sensor 9 measures the pressure difference between the inside of the casing 2 and a point 16 situated on the duct 7 beyond the orifice 23 with respect to the casing 2.

Figure 4:
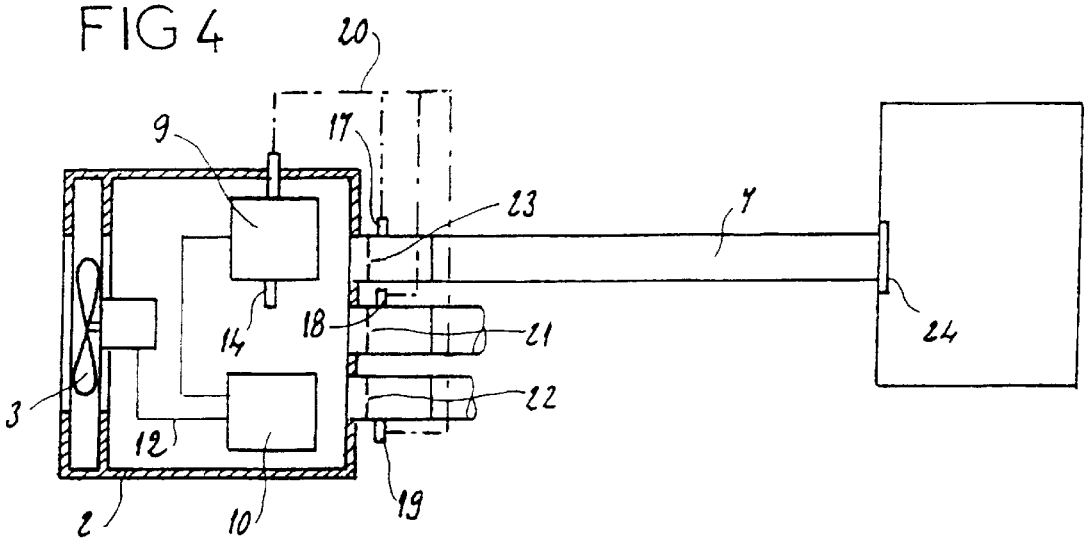

FIG. 4 depicts a third embodiment of the invention in which the same elements are denoted by the same references as before. In this case, three tubes 17, 18 and 19 respectively, which meet as a common tube 20 connected to the pressure sensor 9, make it possible to determine the mean pressure in the ducts connected to the tappings 4, 5 and 6. The differential-pressure sensor 9 also takes the pressure inside the casing 2 via the tube 14. The sensor 9 measures the pressure difference between the mean pressure inside the ducts 7 and the pressure inside the casing 2, the orifices 21, 22 and 23 being arranged between the pressure tappings 4, 5, and 6.

Figure 5:
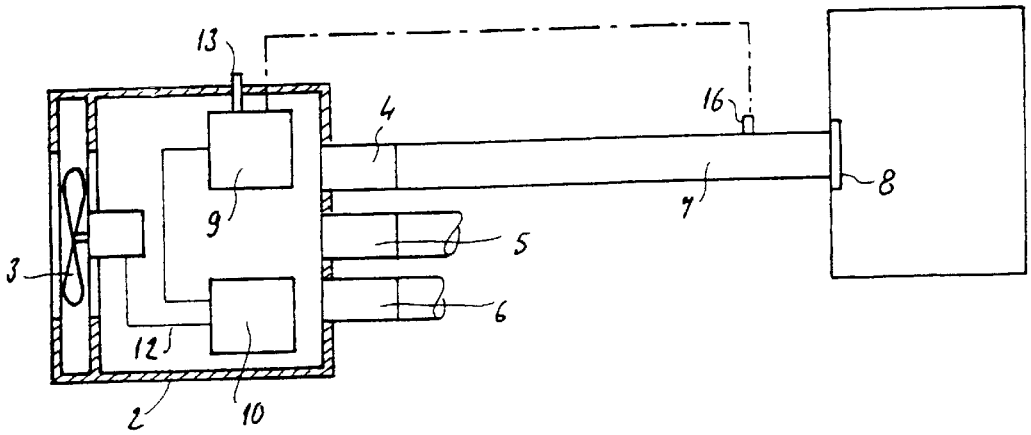
FIGS. 5 and 6 are diagrammatic views illustrating connection for measuring the differential pressure for controlling the ventilation unit in which the ventilation unit is associated with variable cross section openings.

In a fourth embodiment of the invention depicted in FIG. 5, in which the same elements are denoted by the same references as before, the orifice 23 is replaced by an opening 8 opening into a room that is to be ventilated, and the differential pressure is measured between a point 16 opening into the duct 7 (which is between the opening 8 and the casing 2), and a pressure tapping 13 outside the casing 2.

Figure 6:
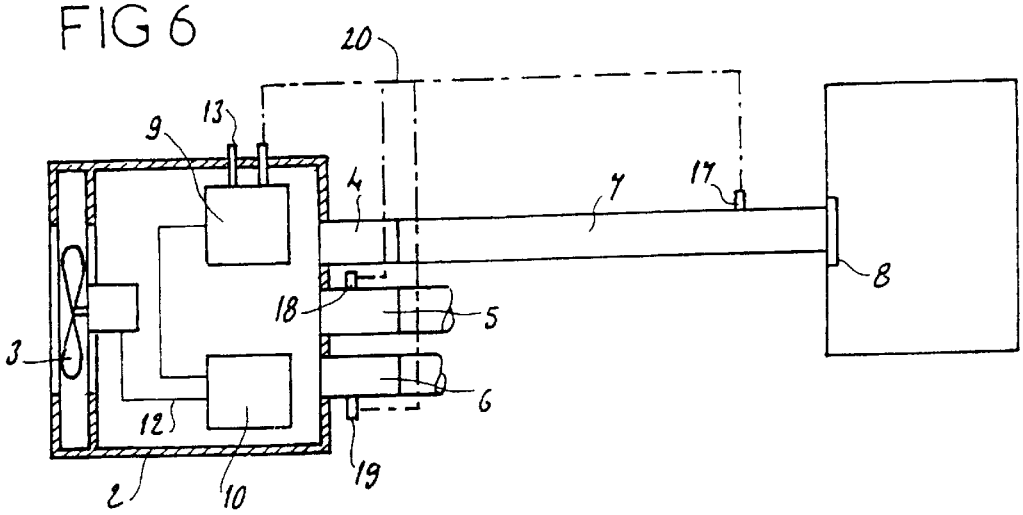

In a fifth embodiment of the invention depicted in FIG. 6, which corresponds to the embodiment depicted in FIG. 4 except replacing the orifice 23 with an opening 8 opening into the room that is to be ventilated, the differential pressure measured being obtained by measuring the mean of the pressures in the ducts 7 and the pressure external to the casing 2 which is obtained by measurement at the tapping 13.

In all cases, the speed of the fan is tailored to keep the pressure difference measured by the sensor 9 constant.

An additional advantage of the ventilation unit according to the invention lies in the uniqueness of the drive solution, regardless of the number of tappings, which can vary, for example, from between one and four, and to which air circulation ducts may be connected without penalizing the performance.

As is evident from the foregoing, the invention makes a vast improvement to the existing art by providing a regulated ventilation casing allowing either very stable flow rates or allowing the variations in flow rate to self adapt using just one drive solution in the casing, while at the same time optimizing the acoustics and the consumption.

As goes without saying, the invention is not restricted solely to the embodiments of this device which have been described hereinabove by way of nonlimiting examples; on the contrary, it encompasses all alternatives thereof. Thus in particular, it would be possible to produce a ventilation casing which could be regulated on the basis of other pressure differences or it would be possible to combine certain pressure-difference measurements in a different way or it would be possible to combine the pressure differences supplied by two sensors, for example sending them to the same analysis and control box, giving precedence to the measurement which encourages the best fan operating.

What is claimed is:

1. An electronically regulated self-controlled ventilation unit, comprising:

a fan driven electrically;

a casing having a duct formed therein, the duct connected with a room, the fan being mounted in the casing;

orifices of a determined cross section; and a differential-pressure sensor measuring a pressure difference between two predetermined points, the measured differential-pressure value being transmitted to an analysis and control device which compares the differential-pressure value with a reference value and controls a rotational speed of the fan, so as to keep the differential-pressure value constant and equal to the reference value to maintain a desired ventilation flow rate at the orifices.

2. The ventilation unit as claimed in claim 1, wherein the control device acts on a level of supply voltage supplied to the fan.

3. The ventilation unit as claimed in claim 1, wherein the ventilation flow rates at the orifices of determined cross section are controlled by controlling the pressure difference between an inside and an outside of the casing.

4. The ventilation unit as claimed in claim 1, wherein the ventilation flow rates at the orifices of determined cross section are controlled by controlling a differential pressure across a calibrated orifice.

5. The ventilation unit as claimed in claim 4, wherein the flow rates at the calibrated orifices of variable cross section are controlled by controlling a differential pressure across the orifices, a pressure external to the casing being equal to a pressure of the room.

6. The ventilation unit as claimed in claim 1, wherein the differential-pressure sensor measures a pressure difference between at least one point situated on the air duct and an inside of the casing.

7. The ventilation unit as claimed in claim 6, wherein the differential-pressure sensor measures the pressure difference between a mean value of pressures inside a plurality of the air passage ducts and a pressure inside the casing, wherein several tubes opening into the ducts converge into a tube which is connected to the sensor.

8. The ventilation unit as claimed in claim 1, wherein the control device acts on a shape of supply current supplied to the fan.

9. The ventilation unit as claimed in claim 4, wherein the calibrated orifice is disposed on the casing.

10. The ventilation unit as claimed in claim 4, wherein the calibrated orifice comprises an air extraction or inlet opening.

11. The ventilation unit as claimed in claim 4, wherein the calibrated orifice is of a constant cross-section.

12. The ventilation unit as claimed in claim 4, wherein the calibrated orifice is of a variable cross-section.

13. The ventilation unit as claimed in claim 5, wherein the calibrated orifice is disposed on the casing.

14. The ventilation unit as claimed in claim 5, wherein the calibrated orifice comprises an air extraction or inlet opening.

15. The ventilation unit as claimed in claim 5, wherein the calibrated orifice is of a constant cross-section.

16. The ventilation unit as claimed in claim 5, wherein the calibrated orifice is of a variable cross-section.

* * * * *